US006640557B1

(12) United States Patent
Arman et al.

(10) Patent No.: US 6,640,557 B1
(45) Date of Patent: Nov. 4, 2003

(54) MULTILEVEL REFRIGERATION FOR HIGH TEMPERATURE SUPERCONDUCTIVITY

(75) Inventors: Bayram Arman, Grand Island, NY (US); Arun Acharya, East Amherst, NY (US); Dante Patrick Bonaquist, Grand Island, NY (US); John Henri Royal, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/277,884

(22) Filed: Oct. 23, 2002

(51) Int. Cl.[7] ..... F17C 13/00; F25D 23/12; F25D 17/02; H01B 12/00; H01R 4/68

(52) U.S. Cl. ..... 62/50.7; 62/434; 62/259.2; 174/15.5; 505/100

(58) Field of Search ..... 62/434, 51.1, 259.2, 62/50.7; 174/15.5; 505/100

(56) References Cited

U.S. PATENT DOCUMENTS

| | | | | | |
|---|---|---|---|---|---|
| 3,604,832 | A | * | 9/1971 | Kohler et al. | 174/15.5 |
| 3,657,467 | A | * | 4/1972 | Matthaus et al. | 174/15.5 |
| 3,946,141 | A | * | 3/1976 | Schmidt | 174/11 R |
| 3,950,606 | A | * | 4/1976 | Schmidt | 174/15.5 |
| 4,718,239 | A | | 1/1988 | Nowobilski et al. | 62/55 |
| 4,726,199 | A | * | 2/1988 | Takano et al. | 62/505 |
| 4,796,433 | A | * | 1/1989 | Bartlett | 62/47.1 |
| 5,553,457 | A | | 9/1996 | Reznikov | 62/81 |
| 5,647,218 | A | | 7/1997 | Kuriyama et al. | 62/6 |
| 5,765,391 | A | | 6/1998 | Lee et al. | 62/442 |
| 5,966,944 | A | | 10/1999 | Inoue et al. | 62/51.1 |
| 6,065,305 | A | | 5/2000 | Arman et al. | 62/613 |
| 6,076,372 | A | * | 6/2000 | Acharya et al. | 62/606 |
| 6,205,812 | B1 | | 3/2001 | Acharya et al. | 62/607 |
| 6,255,595 | B1 | | 7/2001 | Metra et al. | 174/125.1 |
| 6,327,865 | B1 | | 12/2001 | Bonaquist et al. | 62/79 |
| 6,342,673 | B1 | | 1/2002 | Verhaege et al. | 174/15.5 |
| 6,354,087 | B1 | | 3/2002 | Nakahara et al. | 62/6 |
| 6,374,617 | B1 | | 4/2002 | Bonaquist et al. | 62/6 |
| 6,415,611 | B1 | | 7/2002 | Acharya et al. | 62/3.1 |
| 2002/0098985 | A1 | * | 7/2002 | Ladie' et al. | 505/100 |
| 2002/0134533 | A1 | * | 9/2002 | Bechis et al. | 165/104.19 |
| 2003/0019660 | A1 | * | 1/2003 | Spreafico | 174/125.1 |

* cited by examiner

*Primary Examiner*—William C. Doerrler
(74) *Attorney, Agent, or Firm*—Stanley Ktorides

(57) ABSTRACT

A method for refrigerating a high temperature superconducting device to maintain superconducting operating conditions wherein a first heat transfer means such as a first heat transfer fluid is cooled to a temperature greater than the temperature of saturated liquid nitrogen and is used for ambient heat intercept while a second heat transfer means such as a second heat transfer fluid is cooled to a temperature within the high temperature superconductivity temperature operating range to maintain superconducting operating conditions.

8 Claims, 2 Drawing Sheets

MULTILEVEL REFRIGERATION FOR HIGH TEMPERATURE SUPERCONDUCTIVITY

TECHNICAL FIELD

This invention relates generally to refrigeration and, more particularly, to refrigeration for high temperature superconductivity applications.

BACKGROUND ART

Superconductivity is the phenomenon wherein certain metals, alloys and compounds lose electrical resistance so that they have infinite electrical conductivity. Until recently, superconductivity was observed only at extremely low temperatures just slightly above absolute zero. Maintaining superconductors at such low temperatures is very expensive, typically requiring the use of liquid helium, thus limiting the commercial applications for this technology.

Recently a number of materials have been discovered which exhibit superconductivity at higher temperatures, such as in the range from 15 to 75 K. While such materials may be kept at their superconducting temperatures using liquid helium or very cold helium vapor, such a refrigeration scheme is quite costly. Unfortunately liquid nitrogen, a relatively low cost way to provide cryogenic refrigeration, cannot effectively provide refrigeration to get down to the superconducting temperatures of most high temperature superconductors.

An electric transmission cable made of high temperature superconducting materials offers significant benefits for the transmission of large amounts of electricity with very little loss. High temperature superconducting material performance generally improves roughly an order of magnitude at temperatures of about 30 to 50 K from that at temperatures around 80 K which is achieved using liquid nitrogen.

The application of superconducting systems such as cable, transformer, fault current controller/limitor and others is dependent in part on the development of economic refrigeration systems. Superconducting systems need to be maintained at temperatures in the range of 4 to 80 K. However, the system needs to be shielded from heat leak starting at ambient temperature down to the operating temperature of the superconducting system. Refrigeration below liquid nitrogen temperatures becomes excessively expensive, as the temperature gets lower when compared to liquid nitrogen level refrigeration. Liquid nitrogen level refrigeration is considerably less expensive but is not cold enough for-most-high temperature superconductivity applications.

Accordingly, it is an object of this invention to provide a method for refrigerating a high temperature superconducting device which requires less power and thus less cost than heretofore available systems.

SUMMARY OF THE INVENTION

The above and other objects, which will become apparent to those skilled in the art upon a reading of this disclosure, are attained by the present invention which is:

A method for cooling a high temperature superconducting device comprising:

(A) providing a high temperature superconducting device operating at a temperature within a high temperature superconductivity temperature range of from 20 to 80 K;

(B) cooling a first heat transfer means to a first temperature which exceeds the temperature of saturated liquid nitrogen, and warming the cooled first heat transfer means by intercepting ambient heat from passing to the high temperature superconducting device; and (C) cooling a second heat transfer means to a second temperature within the high temperature superconductivity temperature range, and warming the cooled second heat transfer means by heat exchange with the high temperature superconducting device to maintain the high temperature superconducting-device within the high temperature superconductivity temperature range.

As used herein, the term "high temperature superconducting device" means an electrical device such as a cable, transformer, fault current controller/limitor or magnet, in which the electrical resistance to the passage of current is reduced to essentially zero while being maintained at superconducting temperatures.

DETAILED DESCRIPTION

Figure 1:
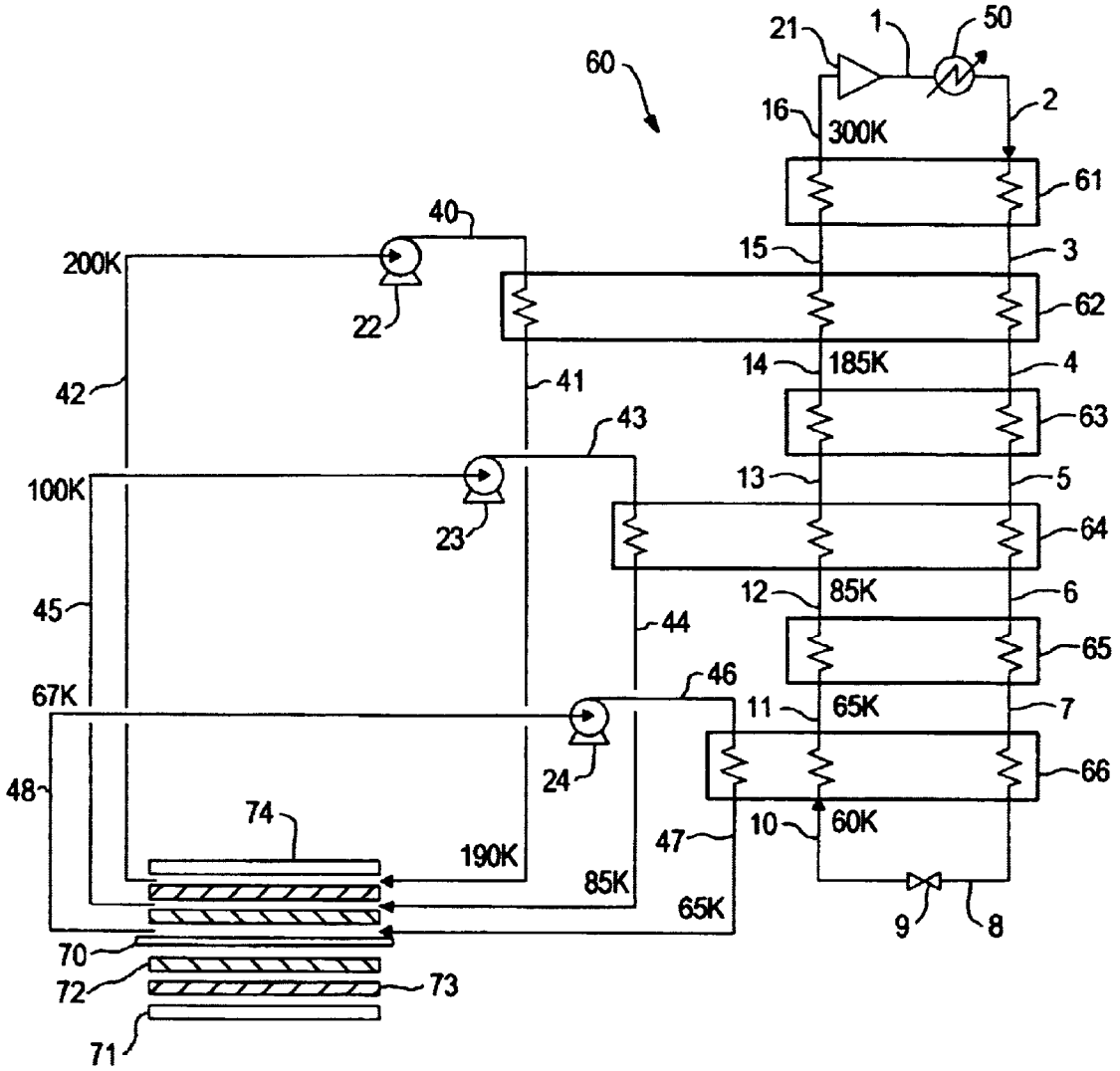
FIG. 1 is a schematic representation of one preferred embodiment of the invention wherein refrigeration is generated using a recirculating multicomponent refrigerant fluid, the high temperature superconducting device is electrical cable, and the means used to refrigerate the superconducting device are fluids which circulate in discrete circuits.

The invention comprises the discovery that a reduction in the power required to maintain a high temperature superconducting device at the requisite temperature can be attained by removing the heat at more than one level rather than at just the requisite temperature and, moreover, that a significant reduction in such required power is attained when the warmest level is at a temperature which exceeds the temperature of saturated liquid nitrogen which, at atmospheric pressure, is 77 K.

The invention will be described in detail with reference to the Drawings. Any effective refrigeration system may be employed in the practice of this invention to generate the refrigeration for the operation of the high temperature superconducting device. In the embodiment of the invention illustrated in FIG. 1, the refrigeration system employed is a single loop system employing a multicomponent refrigerant fluid. The multicomponent refrigerant system may also have internal recycle loops to avoid freezing of heavier refrigerant components or it may have more than one loop. A multicomponent refrigerant fluid is a fluid comprising two or more species and capable of generating refrigeration. The multicomponent refrigerant fluid which may be used in the practice of this invention preferably comprises at least two species from the group consisting of fluorocarbons, hydrofluorocarbons, hydrochlorofluorocarbons, fluoroethers, atmospheric gases and hydrocarbons, e.g. the multicomponent refrigerant fluid could be comprised only of two different fluorocarbons.

One preferred multicomponent refrigerant fluid useful with this invention preferably comprises at least one component from the group consisting of fluorocarbons, hydrofluorocarbons, and fluoroethers, and at least one component from the group consisting of fluorocarbons, hydrofluorocarbons, hydrochlorofluorocarbons, fluoroethers, atmospheric gases and hydrocarbons.

In one preferred embodiment of the invention the multicomponent refrigerant fluid consists solely of fluorocarbons. In another preferred embodiment of the invention the multicomponent refrigerant fluid consists solely of hydrocarbons. In another preferred embodiment of the invention the multicomponent refrigerant fluid consists solely of fluorocarbons and hydrofluorocarbons. In another preferred embodiment of the invention the multicomponent refrigerant fluid consists solely of fluorocarbons, fluoroethers and atmospheric gases. In another preferred embodiment of the invention the multicomponent refrigerant fluid consists solely of hydrocarbons and atmospheric gases. Most preferably every component of the multicomponent refrigerant fluid is either a fluorocarbon, hydrofluorocarbon, fluoroether, hydrocarbon or atmospheric gas. One particularly preferred multicomponent refrigerant fluid for use in the practice of this invention is shown in Table 1.

TABLE 1

| Component | Concentration (Mole Percent) |
|---|---|
| $C_3F_7$—O—$CH_3$ | 2–10 |
| $C_3F_8$ | 5–25 |
| $CF_4$ | 10–55 |
| Ar | 0–30 |
| $N_2$ | 1–55 |
| Ne | 0–10 |

Referring now to FIG. 1, warm multicomponent refrigerant fluid 16, typically at ambient temperature, is compressed by passage through compressor 21 to a pressure generally within the range of from 100 to 2000 pounds per square inch absolute (psia). Resulting compressed refrigerant fluid 1 is cooled of the heat of compression by passage through aftercooler 50 and then passed as stream 2 into heat exchanger system 60 of the refrigeration cycle. In the embodiment of the invention illustrated in FIG. 1 the heat exchanger system 60 comprises six modules or sections numbered 61, 62, 63, 64, 65 and 66 running from the warmest (section 61) to the coldest (section 66). In FIG. 1 these sections are shown as being separate sections although it is understood that some or all of these sections could be incorporated into a common structure.

The refrigerant fluid is cooled by passage through the heat exchanger sections by indirect heat exchange with warming multicomponent refrigerant fluid in the return leg as will be more fully described below. The cooling refrigerant fluid is shown as progressively cooler streams 3, 4, 5, 6 and 7 respectively between the heat exchanger sections, emerging from heat exchanger system 60 as cooled multicomponent refrigerant fluid 8. The cooled multicomponent refrigerant fluid 8 is then expanded to generate refrigeration through expansion device 9 which may be a turboexpander wherein the expansion is isentropic, or may be a Joule-Thomson valve wherein the expansion is isenthalpic. The resulting refrigeration bearing multicomponent refrigerant fluid 10 is then passed back into heat exchanger system 60 for the warming leg of the refrigeration cycle. FIG. 1 also serves to illustrate an example of the invention, which is presented for illustrative purposes and is not intended to be limiting, wherein representative or typical temperatures are identified with various streams of the illustrated embodiment. As shown in FIG. 1, the warming multicomponent refrigerant fluid, shown as streams 11, 12, 13, 14 and 15, emerging from warm heat exchanger section 61 as warm multicomponent refrigerant fluid 16, has a temperature which runs from 60 K to 300 K.

Any high temperature superconducting device may be used in the practice of this invention. Examples of such high temperature superconducting devices include cables, transformers and fault current controllers/limitors. In the embodiment of the invention illustrated in FIG. 1, the high temperature superconducting device is a cable 70. Preferably, as illustrated in FIG. 1, the high temperature superconducting device is insulated with multiple layers of insulation including an outer layer 71 and an inner layer 72 which is closest to the superconducting device. The embodiment illustrated in FIG. 1 has an additional layer of insulation 73 positioned between insulation layers 71 and 72. The high temperature superconducting device is operating at a temperature within a high temperature superconductivity range of from 20 to 80 K, preferably within the range of from 30 to 65 K. In the example of the embodiment illustrated in FIG. 1 the high temperature superconducting cable 70 is operating at a temperature of about 65 K.

The embodiments of the invention illustrated in the Drawings are preferred embodiments wherein the heat transfer means are heat transfer fluids. Other heat transfer means which may be used in the practice of this invention include conductive blocks.

The heat transfer fluids which may be used in the practice of this invention are preferably species from the groups atmospheric gases, hydrocarbons, fluorocarbons, hydrofluorocarbons, fluoroethers and hydrofluoroethers. Mixtures of species to make up a single heat transfer fluid may be used, especially when a single heat transfer fluid is used for providing refrigeration at each of the temperature levels as is the case with the embodiment of the invention illustrated in FIG. 2.

Referring back now to FIG. 1, first heat transfer fluid 42, which in the example of the embodiment illustrated in FIG. 1 is at a temperature of 200 K, is pumped by pump 22 and passed in line 40 to second heat exchanger section 62 wherein it is cooled by indirect heat exchange with the warming multicomponent refrigerant fluid 14 to a temperature which exceeds the temperature of saturated liquid nitrogen and generally to within the range of from 100 to 275 K. In this example the first heat transfer fluid is cooled to a temperature of 190 K. Examples of fluids which may be used as the first heat transfer fluid in the practice of this invention include $CF_4$, $C_3F_8$, $C_3F_7$-O-$CH_3$, mixtures of $CF_4$ and $C_3F_8$, and mixtures of $C_3H_6$ and $C_4H_{10}$. The cooled first heat transfer fluid 41 is then used to intercept ambient heat from passing to the high temperature superconducting device. In the embodiment of the invention illustrated in FIG. 1, cooled first heat transfer liquid 41 is passed to and through insulated assembly 74 between outer insulation layer 71 and inner insulation layer 72. In the process the first heat transfer fluid is warmed to form heat transfer fluid stream 42 for recycle to pump 22.

Second heat transfer fluid 48, which in the embodiment of the invention illustrated in FIG. 1 has a different composition from that of the first heat transfer fluid, is passed to pump 24. Examples of fluids which may be used as the second heat transfer fluid in the practice of this invention include argon, mixtures of argon and oxygen, mixtures of nitrogen and oxygen, mixtures of nitrogen and argon, and mixtures of $N_2$ and $CF_4$. In the example of the embodiment illustrated in FIG. 1 the second heat transfer fluid in stream 48 is at a temperature of 67 K. From pump 24 the second heat transfer fluid is passed in line 46 to sixth or coldest heat exchanger section 66 wherein it is cooled by indirect heat exchange with warming multicomponent refrigerant fluid 10 to a temperature within the high temperature superconductivity temperature range. In this example the second heat transfer fluid is cooled to a temperature of 65 K. The cooled second heat transfer fluid 47 is then warmed by heat exchange, either direct or indirect heat exchange, with the high temperature superconducting device to maintain the high temperature superconducting device within the high temperature superconductivity temperature range. In the embodiment of the invention illustrated in FIG. 1, cooled second heat transfer fluid 47 is passed to and through insulated assembly 74 between inner insulation layer 72 and superconducting cable 70. In the process the second heat transfer fluid is warmed to form heat transfer fluid stream 46 for recycle to pump 24.

Heat leak into the high temperature superconducting device may be intercepted at one or more temperatures intermediate to the temperatures of the cooled first and second heat transfer fluids. The embodiment of the invention illustrated in FIG. 1 employs one such intermediate cooling loop. In this embodiment, a third heat transfer fluid 45, which may have the same composition as or a different composition from the compositions of the first heat transfer fluid and/or the second heat transfer fluid, is passed to pump 23. Examples of fluids which may be used as the third heat transfer fluid in the practice of this invention include $CF_4$, mixtures of $CF_4$ and $C_3F_8$, mixtures of Ar and $CF_4$, mixtures of $N_2$ and Ar, mixtures of $N_2$ and $CF_4$ and mixtures of $CH_4$ and $C_2H_6$. In the example of the embodiment illustrated in FIG. 1 the third heat transfer fluid in stream 45 is at a temperature of 100 K. From pump 23 the third heat transfer fluid is passed in line 43 to fourth heat exchanger section 64 wherein it is cooled by indirect heat exchange with warming multicomponent refrigerant fluid 12 to a temperature which is intermediate to that of the temperature of the cooled first heat transfer fluid and the temperature of the cooled second heat transfer fluid. In this example the third heat transfer fluid is cooled to a temperature of 85 K. The cooled third heat transfer fluid 44 is then warmed by the heat leaking through insulation layers 71 and 73. In the embodiment of the invention illustrated in FIG. 1, cooled third heat transfer fluid 44 is passed to and through insulated assembly 74 between inner insulation layer 72 and intermediate insulation layer 73. In the process the third heat transfer fluid is warmed to form heat transfer fluid stream 45 for recycle to pump 23.

Figure 2:
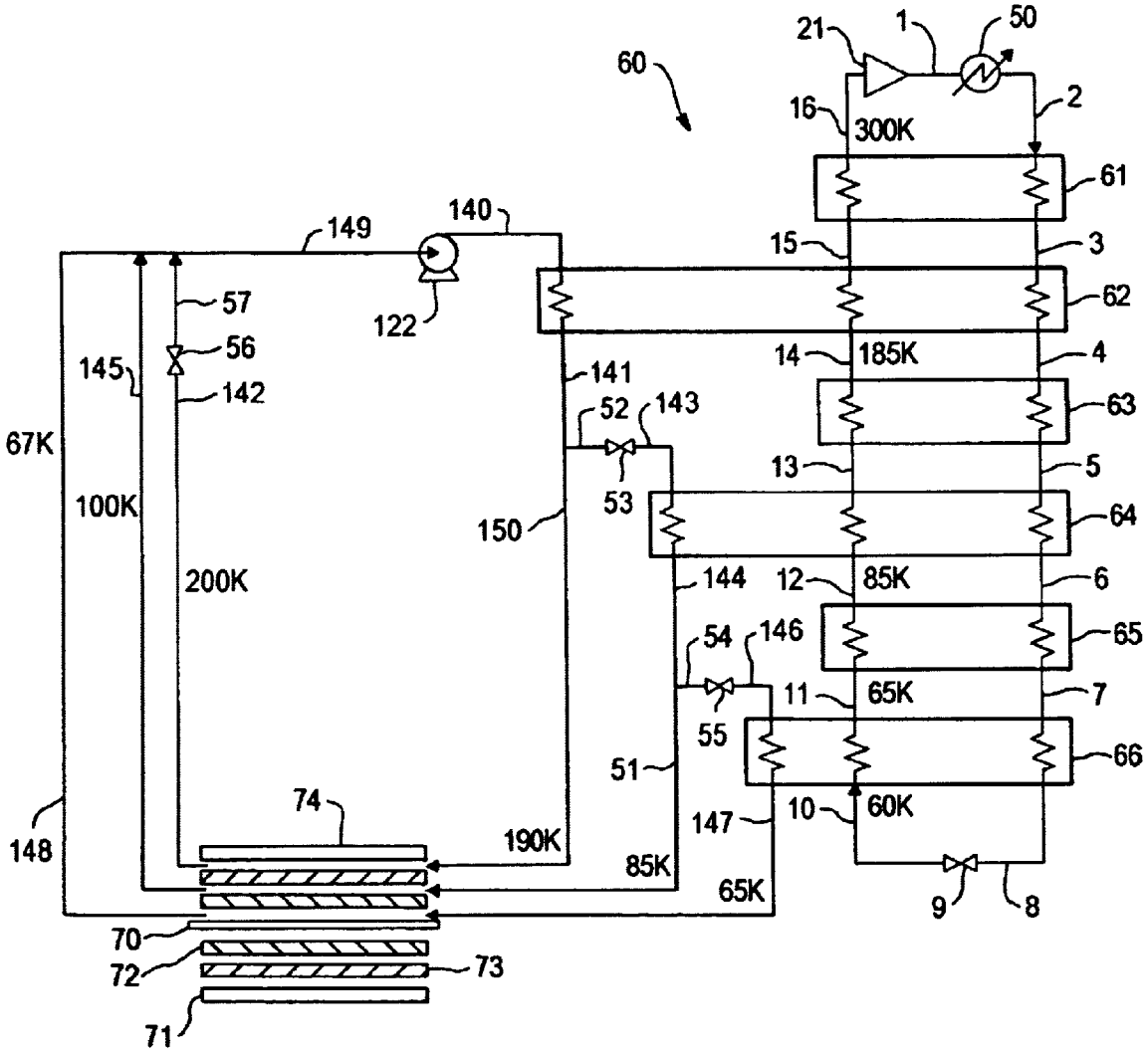
FIG. 2 is a schematic representation of another preferred embodiment of the invention wherein refrigeration is generated using recirculating multicomponent refrigerant fluid, the high temperature superconducting device is electrical cable, and the means used to refrigerate the superconducting device is heat transfer fluid which circulates in an integrated circuit driven by a single pump.

FIG. 2 illustrates another embodiment of the invention wherein a single heat transfer fluid circuit is used to provide refrigeration to the high temperature superconducting device at three temperature levels. Examples of fluids which may be used as the heat transfer fluid in this embodiment of the invention include air, neon, mixtures of $N_2$ and $CF_4$, mixtures of $N_2$, $CF_4$ and $C_3F_8$, mixtures of $N_2$ and Ar, mixtures of $N_2$ and $O_2$ and mixtures of Ar and $O_2$. This embodiment employs a single pump to drive the heat transfer fluids through the circuit rather than the three separate pumps used in conjunction with the embodiment illustrated in FIG. 1. The numerals of FIG. 2 are the same as the numerals of FIG. 1 for the common elements, and these common elements will not be discussed again in detail.

Referring now to FIG. 2, heat transfer fluid 140 is cooled to a first temperature which exceeds the temperature of saturated liquid nitrogen and is generally within the range of from 100 to 275 K by passage through heat exchanger section 62 in indirect heat exchange with warming multicomponent refrigerant fluid 14. Resulting heat transfer fluid 141 is divided into streams 150 and 52. Stream 150 is in this embodiment the first heat transfer fluid of the invention and is processed with respect to the high temperature superconducting device as was previously described with reference to the embodiment illustrated in FIG. 1. Stream 52 is passed through valve 53 and as stream 143 is cooled to an intermediate temperature by passage through heat exchanger section 64 in indirect heat exchange with warming multicomponent refrigerant fluid 12. Resulting heat transfer fluid 144 is divided into streams 51 and 54. Stream 51 is the third heat transfer fluid and is processed with respect to the high temperature superconducting device as was previously described with reference to the embodiment illustrated in FIG. 1. Stream 54 is passed through valve 55 and as stream 146 is cooled to a temperature within the high temperature superconductivity temperature range by passage through heat exchanger section 66 in indirect heat exchange with warming multicomponent refrigerant fluid 10. Resulting heat transfer fluid 147 is in this embodiment the second heat transfer fluid of the invention and is processed with respect to the high temperature superconducting device as was previously described with reference to the embodiment illustrated in FIG. 1. The warmed first and third heat transfer fluids are withdrawn from superconducting device assembly 74 in streams 142 and 145 respectively and stream 142 is passed through valve 56 to form stream 57. These streams are recombined with stream 148 which comprises the warmed second heat transfer fluid from superconducting device assembly 74 to form combined heat transfer fluid stream 149 for passage to pump 122 to complete the heat transfer fluid circuit.

Although the invention has been described in detail with reference to certain preferred embodiments, those skilled in the art will recognize that there are other embodiments of the invention within the spirit and the scope of the claims. For example, a multistage Brayton refrigeration cycle may be used in place of the multicomponent refrigerant fluid cycle to generate refrigeration to cool the first and second heat transfer means.

What is claimed is:

1. A method for cooling a high temperature superconducting device comprising:

(A) providing a high temperature superconducting device operating at a temperature within a high temperature superconductivity temperature range of from 20 to 80 K;

(B) cooling a first heat transfer means to a first temperature which exceeds the temperature of saturated liquid nitrogen, and warming the cooled first heat transfer means by intercepting ambient heat from passing to the high temperature superconducting device; and (C) cooling a second heat transfer means to a second temperature within the high temperature superconductivity temperature range, and warming the cooled second heat transfer means by heat exchange with the high temperature superconducting device to maintain the high temperature superconducting device within the high temperature superconductivity temperature range, wherein the first heat transfer means comprises first heat transfer fluid and the second heat transfer means comprises second heat transfer fluid and wherein the first heat transfer fluid and the second heat transfer fluid circulate in an integrated circuit.

2. The method of claim 1 wherein the high temperature superconducting device is insulated using an outer insulation layer and an inner insulation layer which is positioned closer to the high temperature superconducting device than is the outer insulation layer.

3. The method of claim 2 wherein the cooled first heat transfer fluid is passed between the inner and outer insulation layers.

4. The method of claim 2 wherein the cooled second heat transfer fluid is passed between the inner insulation layer and the high temperature superconducting device.

5. The method of claim 1 wherein the first heat transfer fluid is cooled by indirect heat exchange with a multicomponent refrigerant fluid.

6. The method of claim 1 wherein the second heat transfer fluid is cooled by indirect heat exchange with a multicomponent refrigerant fluid.

7. The method of claim 1 wherein the high temperature superconducting device is electrical cable.

8. A method for cooling a high temperature superconducting device comprising:

(A) providing a high temperature superconducting device operating at a temperature within a high temperature superconductivity temperature range of from 20 to 80 K;

(B) cooling a first heat-transfer means to a first temperature which exceeds the temperature of saturated liquid nitrogen, and warming the cooled first heat transfer means by intercepting ambient heat from passing to the high temperature superconducting device; and (C) cooling a second heat transfer means to a second temperature within the high temperature superconductivity temperature range, and warming the cooled second heat transfer means by heat exchange with the high temperature superconducting device to maintain the high temperature superconducting device within the high temperature superconductivity temperature range, wherein the first heat transfer means comprises first heat transfer fluid and the second heat transfer means comprises second heat transfer fluid and further comprising cooling a third heat transfer fluid to a third temperature which is less than the first temperature and greater than the second temperature, and warming the cooled third heat transfer fluid by indirect heat exchange with the high temperature superconducting device.

* * * * *